United States Patent [19]

Marcandalli

[11] Patent Number: 4,599,957

[45] Date of Patent: Jul. 15, 1986

[54] LOOPER ACTUATING DEVICE FOR SEWING MACHINES

[75] Inventor: Ulderico Marcandalli, Milan, Italy

[73] Assignee: Rockwell-Rimoldi S.p.A., Italy

[21] Appl. No.: 756,175

[22] Filed: Jul. 18, 1985

Related U.S. Application Data

[63] Continuation of Ser. No. 450,940, Dec. 20, 1982, abandoned.

[30] Foreign Application Priority Data

Apr. 21, 1982 [IT] Italy ..... 20860 A/82

[51] Int. Cl.[4] ..... D05B 1/06; D05B 57/04

[52] U.S. Cl. ..... 112/199

[58] Field of Search ..... 112/159, 165, 166, 199

[56] References Cited

U.S. PATENT DOCUMENTS

| | | | |
|---|---|---|---|
| 623,351 | 4/1899 | Bouton et al. | 112/166 |
| 3,628,481 | 12/1971 | Gross | 112/199 |
| 3,742,880 | 7/1973 | Franz | 112/199 |

*Primary Examiner*—Wm. Carter Reynolds

[57] ABSTRACT

A looper operating device for sewing machines in which the looper is provided with forward movement and the machine's needle possesses work feeding movement which is synchronized and caused to perform its intended function simultaneously with the machine's feed dog. The device includes a lever member having an upper fulcrum to which actuating linkage for the looper are connected. The opposite end of the lever member includes a lower fulcrum 25 connected to a lever element mounted on a shaft that is operatively connected to and simultaneously actuates both the feed dog and needle. This lever element is stationary when the stitch length is zero or is oscillating with an amplitude proportional to the stitch length. The lever member includes an intermediate fulcrum 27 connected to an oscillating member of constant amplitude which is equivalent to the oscillation of the looper whereby for a zero stitch length, the start of the arc defined by the tip of the looper is fixed, and when increasing the stitch length, the start of the arc is proportionally moved from the vertical that passes through the lower dead point of the needle and occurs in a reverse manner when the stitch length is reduced.

2 Claims, 3 Drawing Figures

LOOPER ACTUATING DEVICE FOR SEWING MACHINES

This is a continuation of application Ser. No. 450,940, filed Dec. 20, 1982, now abandoned.

BACKGROUND OF THE INVENTION

1. Field of the Invention

The invention pertains to an operating device for a forward moving looper in sewing machines of the type in which the needle has work feeding movements. In such machines the orbital movement of the fabric feed dog is synchronized with an analogous movement of the machine's needle and, to assist in the transport of the fabric, it is caused to penetrate the latter and to be displaced simultaneously with the feed dog.

2. Description of the Prior Art

In machines in which the needle has a work feeding movement, the length of the stitch of a seam can be adjusted from zero up through intermediate values to a maximum value. When the stitch length is zero, the feed dog only performs a raising and lowering movement, the needle follows a vertical trajectory and the looper performs an oscillating movement thereby its tip is at a pre-established distance from the vertical which passes through the lower dead point of the needle.

When the sewing machine is set up to produce a certain stitch length, both the needle and the feed dog, being synchronized, are caused to be displaced simultaneously so as to effect transport or advance the fabric. A problem, however, exists with such sewing machines for the looper continues to form the stitches in a conventional manner regardless of machine set up for a particular length stitch and at whatever position the needle is withdrawn relative to the vertical that passes through the lower dead point of the needle.

Sewing machines of the type described supra are well known to those conversant in the art and an example of one such machine is shown and described in U.S. Pat. No. 2,266,140. The teachings of this patent show and describe a device for operating a looper at a variable velocity which is effective in increasing the velocity of the looper when necessary so that its tip will seize the loop of needle thread. With this arrangement, the transport movements of the machine's needle are also variable. Although the mechanisms of this patent have performed their intended functions with a degree of satisfaction, they possess what is considered an extremely complicated arrangement of elements having limitations under certain conditions which do not consistently provide for the seizure of the needle thread loop.

Another sewing machine of the type referred to above is shown and described in U.S. Pat. No. 3,285,210. The teachings of this patent disclose an apparatus which satisfactorily performs its intended function but, unlike the present invention, it is necessary that the operating device for the looper be regulated each and every time it is desirable to vary the stitch length in a machine as well as when the transport movements of the needle are varied. In addition to this required regulation of the looper operating device, it is only possible to obtain stitch lengths of predetermined value and not intermediate values as is available with the device according to the invention. The invention provides an operating device for a sewing machine looper having forward movements and a needle that is provided with work feeding movements. The device includes means for simultaneously and adjustably operating the feed dog and needle during their work feeding movements and for causing the looper to oscillate. This oscillating is initiated in a manner whereby, upon an increase in stitch length, the start of the arc made by the point of the looper is moved away from the vertical passing through the lower dead point of the needle. With a decrease in the stitch length, the start of the arc made by the point of the looper is caused to move towards the vertical passing through the lower dead point of the needle and the displacements toward and away from this vertical define the extent proportional to the selected stitch length.

SUMMARY OF THE INVENTION

The looper operating device comprising the present invention includes a lever member provided with an upper fulcrum to which the actuating linkage for the looper is operatively connected. The opposite end of the lever member is provided with a lower fulcrum connected to a lever that is fixed when the stitch length is zero and which oscillates with a selected stitch length at an amplitude proportional thereto. The lever member includes an intermediate fulcrum connected to an oscillating means of constant amplitude which corresponds to the oscillation of the looper in a manner whereby at zero stitch length the start of the arc formed by the point of the looper is fixed and with an increase in stitch length, the start of the arc is proportionally moved away from the vertical passing through the lower dead point of the needle and in the opposite direction upon diminution of the stitch length. With the position of the three fulcrums on the same vertical, there corresponds the position of the needle at its lower dead point and the point of the looper at a pre-established distance from the vertical passing through the lower dead point of the needle.

The shaft of the device which simultaneously and adjustably operates the feed dog and the needle during their transport movements supports the lever connected to the lower fulcrum and is fixed when the shaft is not oscillating which corresponds to a zero stitch length condition. With a selected stitch length, the lever connected to the lower fulcrum is caused to oscillate with an amplitude proportional to the stitch length. The axis of this shaft is fixed and is disposed on the vertical joining the three fulcrums and corresponds to the position of the needle at its lower dead point.

It is a general object of the invention to provide an operating device for forward moving loopers in sewing machines which possesses improved operating characteristics relative to known devices of the prior art.

A further object is to provide a looper operating device which, upon providing a variation in stitch length, the placing of the looper will occur automatically without intervention on the part of an operator.

These and other objects of the invention will become more fully apparent by reference to the appended claims and as the following detailed description proceeds in reference to the figures of drawings wherein:

DESCRIPTION OF THE PREFERRED EMBODIMENT

Figure 1:
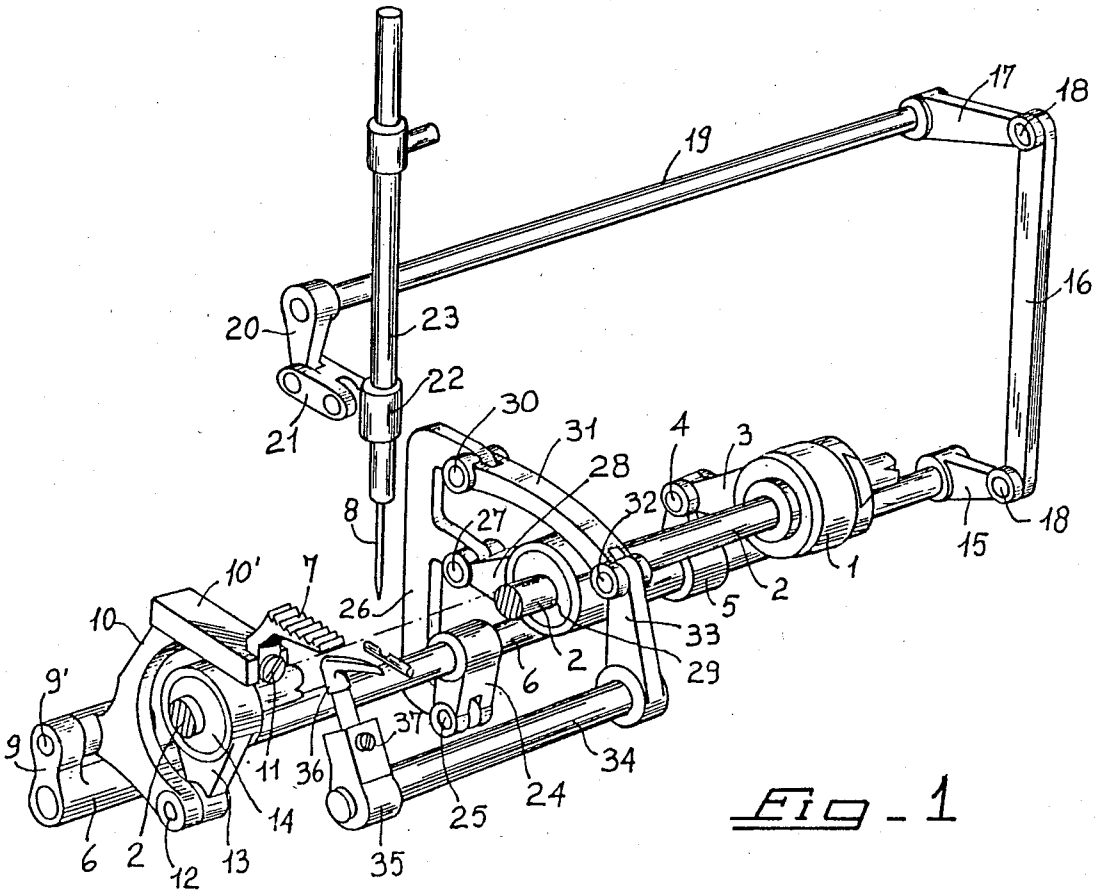
FIG. 1 is a perspective view of a portion of a sewing machine showing the device according to the invention applied thereto.

With reference to FIG. 1, a selectively variable eccentric 1 is mounted on and for rotation with a rotatably driven shaft 2 and, depending on the degree of eccentricity, the eccentric is selected to produce and impart variable oscillations to a connecting rod 3 operatively associated therewith. These oscillations to the connecting rod 3 are eliminated when the eccentric is set up to produce zero eccentricity. The end of the connecting rod 3 most remote from the eccentric 1 has one end of a lever 5 pivotally connected thereto as at 4. The opposite end of this lever 5 is fixed on a drive shaft 6 which simultaneously operates the machine's feed dog 7 and needle 8 during their workpiece transport movements and will be more fully described hereinafter.

The shaft 6 is connected at one end to a lever 9 that is journaled at 9' on a support member 10 which is fixed to a bracket 10' on which feed dog 7 is mounted by means of screws 11. The support member 10 is pivotally connected to a fulcrum 12 on one end of a connecting rod 13. The opposite end of this connecting rod 13 defines an eccentric 14 mounted on the rotatably driven shaft 2. By means of the elements described, the feed dog 7 obtains its known workpiece transport motion and return motion from the oscillations of shaft 6 and its raising and lowering movements from the eccentric 14.

The end of shaft 6 opposite its connection to lever 9 is connected to a lever system 15, 16 and 17 having fulcrums 18 for effecting oscillation of a shaft 19 about its axis. A lever 20 is fixed on one end of the shaft 19 and depending from the latter its lower end is pivotally connected to one end of a linkage member 21. The opposite end of linkage member 21 is pivotally connected to a sleeve 22 assembled on the machine's needle bar 23 and provides the latter with so called work feeding movements. As is well known, the needle bar 23 also possesses alternating vertical movements which combined with the above work feeding movements defines a closed orbital trajectory which cooperates with the orbital trajectory of the feed dog 7.

As shown in FIG. 1, shaft 6 has one end of a lever 24 fixed thereon and the opposite end defines a lower fulcrum 25 for a lever 26 which is also provided with a center or intermediate fulcrum 27 that is pivotally attached to one end of a connecting rod 28. The opposite end of this connecting rod 28 defines an eccentric 29 that is assembled on the rotatably driven shaft 2. Additionally, lever 26 includes an upper fulcrum 30 having one end of a lever 31 pivotally connected thereto. The opposite end of this lever 31 is pivotally connected as at 32 to the upper end of a lever 33. The opposite end of lever 33 is fixed on one end of a shaft 34 which on its opposite end has a looper carrier 35 fixed thereon to which a looper 36 is attached by means of a screw 37.

Figure 3:
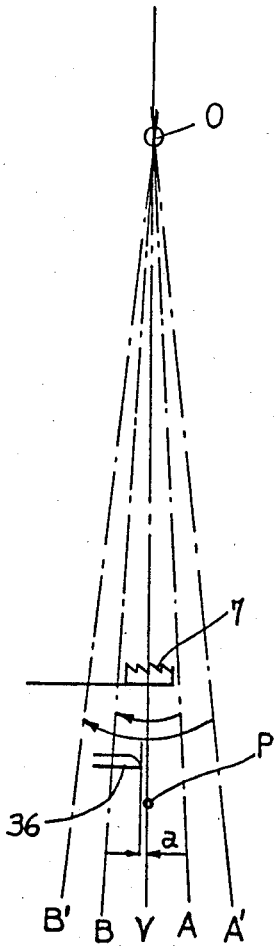
FIG. 3 is a diagrammatic view of the movements through which the machine's needle bar is caused to travel.

It should be noted that when the eccentric 1 is not supplying its drive due to its eccentricity being set at zero, the shaft 6 remains fixed resulting in both the feed dog 7 and the needle 8 performing only their alternating movement along the vertical V (FIG. 3) and do not perform their transport movements. When the feed dog 7 and the needle 8 are not performing their transport movements, the looper 36 performs a constant oscillatory movement corresponding to the oscillations about the lower fulcrum 25 imparted by the eccentric 29. Under this condition, the needle 8 at its lower dead point P (FIG. 3) will be located on the vertical V at a distance a from the point of the looper 36. This distance between the needle and the point of the looper remains constant even when the needle 8 is caused to oscillate with the adjustable workpiece transport movement.

When the eccentric 1 is adjusted to provide a preselected amount of eccentricity so as to impart workpiece transport oscillations to the shaft 6, which are simultaneously transmitted to the feed dog 7 and the needle 8, then, depending on the amount of eccentricity as well as the stitch length, the needle 8, oscillating about O (FIG. 3) penetrates the fabric following the inclined trajectory A or A' and is withdrawn therefrom after the workpiece transport movement along the inclined trajectory B or B'.

Figure 2:
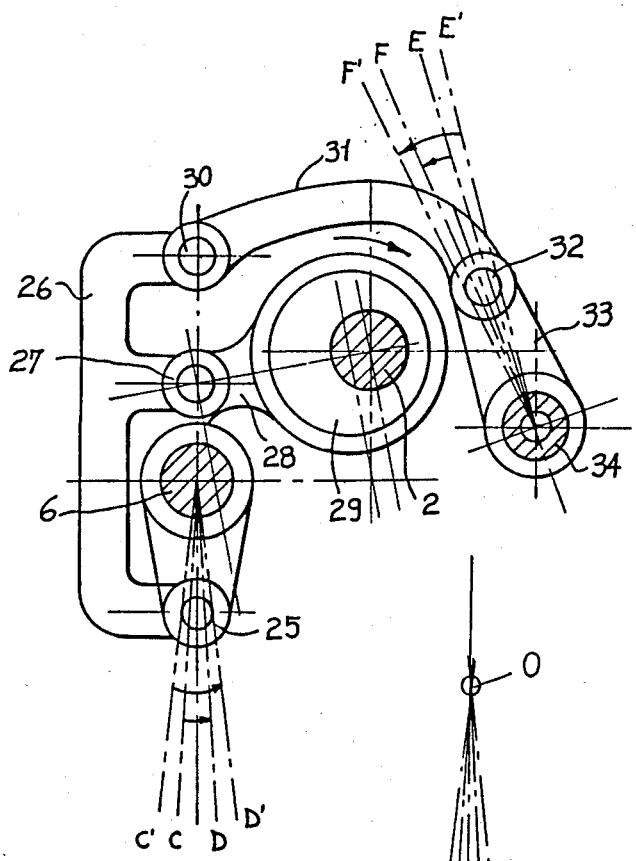
FIG. 2 is a view in side elevation of the linkage elements for effecting actuation of the device shown in FIG. 1.

Referring now to FIG. 2, the oscillation of shaft 6 effects displacement of the lower fulcrum 25 in an anti-clockwise direction in accordance with arcs C,D, or C',D' that correspond to the needle 8 and transport arcs A,B or A',B'. The displacement of the lower fulcrum 25 in an anti-clockwise sense effects displacement of the upper fulcrum 30 to the left (FIG. 2) which then provides similar displacements of the fulcrum 32 in accordance with arcs E,F and E,'F'. These displacements also effect the looper 36 which is moved away from the vertical V by an extent which is proportional to the stitch length when the latter is increased and with a decrease in stitch length the looper moves closer to the vertical V. The arc followed by the point of the looper starts at the locations corresponding to arcs F or F' of the fulcrum 32 and corresponds to the constant displacement to the right of fulcrum 27 that is being moved by eccentric 29. This movement described supra occurs with one 180° rotation of shaft 2 and starting from the position shown in FIG. 2.

Movement of the looper to the left results in a delay in its meeting with the needle which is necessary for as the stitch length increases the workpiece transport trajectory of the needle becomes greater.

When the fulcrums 25, 27 and 30 are on one and the same vertical that passes through the axis of shaft 6, the needle will always be at the lower dead point P and the point of the looper 36 will be at a constant distance a from the vertical V passing through the dead point P.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. An operating device for a forward moving looper in sewing machines of the type having workpiece transport movements performed simultaneously by a needle and feed dog, said operating device comprising:

a rotatably driven shaft mounted in the machine including: a selectively variable eccentric mounted on and for rotation therewith;

a drive shaft spaced from and extending parallel with said rotatably driven shaft having opposite ends thereof operatively connected to said needle and feed dog respectively;

first drive means interconnecting said eccentric with said drive shaft for effecting simultaneous transport movements of said needle and feed dog of varying amplitude depending on the position of said eccentric; and second drive means mounted on said driven shaft for oscillating the looper along a basic path of constant amplitude and means operatively connecting said drive shaft with the looper and effective to modify said basic path so that oscillations of the looper are initiated at constant distance from the withdrawn trajectory of the needle, whose inclination from the vertical depends on the amount of the stitch length.

2. The structure according to claim 1, wherein said last-mentioned means comprises a lever having a lower end defining a lower fulcrum for supporting an additional lever extending upwardly from said lower fulcrum; the upper end of said additional lever defining an upper fulcrum operatively connected through linkage to said looper and said additional lever including an intermediate fulcrum connected to said second drive means.

* * * * *